United States Patent [19]

Arai et al.

[11] Patent Number: 4,664,952

[45] Date of Patent: May 12, 1987

[54] RECORDING MEDIUM AND RECORDING METHOD UTILIZING THE SAME

[75] Inventors: Ryuichi Arai, Sagamihara; Mamoru Sakaki, Atsugi; Shinya Matsui, Yokohama, all of Japan

[73] Assignee: Canon Kabushiki Kaisha, Tokyo, Japan

[21] Appl. No.: 789,836

[22] Filed: Oct. 21, 1985

[30] Foreign Application Priority Data

| | | | |
|---|---|---|---|
| Oct. 23, 1984 | [JP] | Japan | 59-223716 |
| Dec. 6, 1984 | [JP] | Japan | 59-257969 |
| Dec. 15, 1984 | [JP] | Japan | 59-263751 |
| Dec. 21, 1984 | [JP] | Japan | 59-271269 |

[51] Int. Cl.[4] ..... B41M 5/00

[52] U.S. Cl. ..... 427/256; 346/1.1; 346/135.1; 428/195; 428/206; 428/323; 428/409; 428/913

[58] Field of Search ..... 346/135.1, 1.1; 428/195, 207, 211, 323, 324, 328, 913, 914, 208, 409; 427/256, 288, 287

[56] References Cited

U.S. PATENT DOCUMENTS 4,269,891 5/1981 Minagawa ..... 428/207

*Primary Examiner*—Bruce H. Hess

*Attorney, Agent, or Firm*—Fitzpatrick, Cella, Harper & Scinto

[57] ABSTRACT

A recording medium is provided which has a recording surface having a 60° specular gloss of at least 30% according to JIS Z8741 and a Munsell lightness of at least 7.5 according to JIS Z8721. The recording medium may comprise an ink-receiving layer formed thereon. A recording method is also provided which employ the above mentioned recording medium.

6 Claims, No Drawings

RECORDING MEDIUM AND RECORDING METHOD UTILIZING THE SAME

BACKGROUND OF THE INVENTION

1. Field of the Invention

The present invention relates to a recording medium best suited for recording with inks and excellent in ink-receiving properties and in the distinctness and other quality of recorded full-color images and to a recording method utilizing the recording medium.

2. Description of the Related Art

The ink-jet recording process comprises ejecting droplets of recording liquid by various techniques (e.g. the electrostatic attraction technique, the technique of providing mechanical vibration or displacement to the recording liquid by using piezoelectric elements, and the technique of heating the recording liquid to produce a foam and utilizing the foaming pressure), and causing parts or all of the droplets to deposit to a recording medium such as paper. This process draws attention as a recording method capable of high speed printing and multicolor printing, with less noise generation.

Aqueous inks are chiefly used as recording liquids for ink-jet recording from the standpoint of safety and recording characteristics, and a polyhydric alcohol or the like is often added to these inks in order to prevent the nozzle clogging and to improve the discharge stability.

Recording media hitherto used for ink-jet recording are ordinary paper and sheets called ink-jet recording papers which are made by forming porous ink-receiving layers on base paper. However, various sophisticated characteristics are increasingly demanded also for recording media with the improvement of ink-jet recorders in functions, such as the speedup of recording and the development of multicolor recording, and with the spreading use of ink-jet recorders. That is, recording medium for ink-jet recording need to satisfy the following fundamental requirements in order to record good quality images with high resolution.

(1) The recording media should absorb ink as rapidly as possible.

(2) When ink dots overlap each other, the recording media should function so that the later applied ink will not diffuse into the previously marked ink dot.

(3) Ink diffusion on the recording media should not be so great as to enlarge the diameter of ink dots more than necessary.

(4) Ink dots on the recording media should have good circularity and the circumferences of the dots should be smooth.

(5) Ink dots on the recording media should exhibit high O.D. (optical density) and the outline of each dot should not be blurred.

In addition, the following requirements need to be satisfied in order to attain such image quality of high resolution by multicolor ink-jet recording as to be comparable to that of color photographs.

(6) The coloring components of ink should be able to develop excellent colors on a recording medium.

(7) The ink-fixing ability of the recording media should be superior since ink droplets as many as the number of ink colors may overlap one another.

No recording medium satisfying all of these requirements has not been known yet.

Most of the conventional recording media for surface image observation purposes are provided with a porous ink-receiving surface layer, the cells of which serve to receive recording liquids and fix the recording agents thereof. Since the recording agents penetrate deep into the ink-receiving layer, the recorded images are low in distinctness.

When the surface of the ink-receiving layer is nonporous, on the contrary, nonvolatile components of ink remain such as polyhydric alcohols on the surface of the layer for many hours after recording thus long times being required for drying and fixing the ink. Therefore, clothes, if brought into contact with the recorded image, will be stained and the image may be impaired.

SUMMARY OF THE INVENTION

An object of the invention is to provide a recording medium superior particularly in ink-receiving properties and in distinctness of recorded images as well as a recording method utilizing the recording medium.

Another object of the invention is to provide a recording medium on which ink dots uniform in diameter and in optical density and superior in contrast can be obtained, and a recording method utilizing the recording medium.

A further object of the invention is to provide a recording medium on which an image giving perspective feeling and high-quality sensation can be recorded, and a recording method utilizing the recording medium.

The above and other objects of the invention can be achieved with the following recording media and method.

According to one aspect of the invention, there is provided a recording medium which has a recording surface having a 60° specular gloss of at least 30% as measured in accordance with JIS Z8741 and a Munsell lightness of at least 7.5 as measured in accordance with JIS Z8721.

According to another aspect of the invention, there is provided a recording medium comprising a substrate and an ink-receiving layer formed thereon, wherein a recording surface of the ink-receiving layer has a 60° specular gloss of at least 30% as measured in accordance with JIS Z8741 and a Munsell lightness of at least 7.5 as measured in accordance with JIS Z8721.

According to further aspect of the invention, there is provided a recording method comprising forming droplets of recording liquids and causing the droplets to deposit onto a recording medium, characterized in that a recording surface of the recording medium has a 60° specular gloss of at least 30% as measured in accordance with JIS Z8741 and a Munsell lightness of at least 7.5 as measured in accordance with JIS Z8721.

DETAILED DESCRIPTION OF THE PREFERRED EMBODIMENTS

An essential prerequisite for the recording medium of the invention is that the recording surface thereof should have a 60° specular gloss of at least 30% as measured in accordance with JIS Z8741.

When records such as prints, photographs, and written records are illuminated directly or indirectly with diffused light, the recorded images on the records reflect parts of the light and absorb other parts, thereby diffused light corresponding to the images being radiated.

For instance, when illuminated, a completely glossless record reflects light to produce diffused light flux in a complete spherical form relative to the recorded surface regardless of the incident angle distribution of illuminating light.

Moreover, even if a record absorbing 100% of the incident light is made on a recording medium, about 5% of the light will cause diffuse reflection according to Frenel's formula before arriving at absorption sites.

Accordingly, a record which absorbs actually 95% of the incident light will exhibit an apparent optical density (O.D) as low as about 1.0 even if the real O.D. of the record is 1.3.

On the recording medium of the invention, however, having a specular gloss of at least 30%, the apparent O.D. will be about 1.2, the lowering of the apparent O.D. being little. On the other hand, on the glossy surface of the medium, a distinct image of high quality can be recorded, since such a surface is smooth and gives an improved degree of resolution.

Another prerequisite for the recording medium of the invention is that the Munsell lightness should be at least 7.5 as measured in accordance with JIS Z8721. A low lightness is not desirable since it makes the entire image dark and results in a small difference of the reflectivity between a recorded portion and non-recorded portion even with a highest O.D. value, thus resulting an image of low contrast and low mellowness.

In consequence, the recording medium of the invention has a lightness of at least 7.5, preferably at least 8.0, particularly preferably at least 8.5.

When a recording medium in the invention is made of a substrate and an ink-receiving layer, the surface smoothness of the substrate is important to provide a sufficient gloss to the recording surface and attain uniform diameters of ink dots.

Thus, the Bekk smoothness of the substrate, as measured in accordance with JIS P8119, is desirably at least 50 sec., preferably at least 60 sec., for the purpose of attaining uniform diameters of ink dots.

When a recording medium made by coating a substrate having a Bekk smoothness of less than 50 sec. with an ink-receiving layer is used for ink-jet recording, the diamters of ink dots will be nonuniform and no adequate dot O.D. will be attainable. This is because the ink-receiving layer formed on the substrate having a smoothness of less than 50 sec. exhibits a great nonuniformity of thickness on account of the great roughness of the substrate surface.

On the contrary, when ink-jet recording is conducted on the recording medium of the invention comprising a substrate having Bekk smoothness of at least 50 sec., uniform dot diameters and dot O.D. will be attainable because of the small variation in the thickness of the ink-receiving layer. Accordingly, images superior in dot resolution, distinctness, and contrast will be obtained. Additionally, the smooth surface of the substrate will make it possible to control the thickness of the ink receiving layer and the diameters of the dots. Moreover, a small amount of coating material is sufficient to form the ink-receiving layer, because the layer can be made uniform and thin. Further the recording medium comprising a substrate having a Bekk smoothness of at least 500 sec. exhibits a high gloss and an image of high quality and giving perspective sensation can be recorded on the medium.

For the smoothing treatment of substrates having low surface smoothness, well-known means, may be employed such as a machine calendering, supercalendering and gloss calendering.

In order to secure the circularity and gloss of ink dots and the uniformity of the layer thickness, the roughness of the substrate surface to be in contact with the ink-receiving layer should not exceed 20 μm, expressed in terms of the maximum height per a base length of 2.5 mm, as measured in accordance with JIS B0601. The recording medium constituted of a substrate overlaid with an ink-receiving layer having the construction described later satisfies the foregoing various property requirements for ink-jet recording media. Moreover, when ink dots are marked on such a recording medium with droplets of the same ink in the same amounts under the same recording conditions, dots generally uniform in diameter and in O.D. and more distinct images with good contrast can invariably be obtained.

In other words, images exhibiting good distinctness and good contrast are hardly obtainable on the recording medium formed by laminating an ink-receiving layer having the construction described later, on a substrate surface having such a roughness that the maximum height per a base length of 2.5 mm exceeds 20 μm as measured in accordance with JIS B0601. Reasons for this are as follows:

(1) The surface of the ink-receiving layer, formed on the substrate surface having such a roughness as mentioned above, has a rough state nearly corresponding to the roughness of the substrate surface. When ink-jet recording is performed on such a rough surface of the ink-receiving layer, the circumferences of the resulting ink dots will be often deformed or jagged, that is, ink dots having tood circularity and smooth circumferences will be hardly obtained.

(2) Uniform thickness of the laminated ink-receiving layer is difficult to obtain, the absorbability and diffusion state of an ink vary from site to site on the surface of the ink-receiving layer, and hence the dot diameter and O.D., each of which should be definite when droplets of the same ink are applied in the same amounts, vary from dot to dot.

In contrast to this, the recording medium of the invention gives good shapes of ink dots as stated above; since the used substrate has such a smooth surface that nearly equal diameters and densities of ink dots will be obtained when droplets of the same ink are applied in the same amounts under the same recording conditions, the above-mentioned problems are solved and superior quality images with high resolution can be obtained by ink-jet recording.

Moreover, a smoother and glossier recording surface can be formed, and an image of higher quality with more perspective sensation can be recorded on the recording surface, by using a substrate which has such a smooth surface that the maximum height per a base length of 2.5 mm is up to 6 μm, even when an ink-receiving layer of the same construction as above is laminated on the substrate.

When a recording medium is made by using a substrate having a rougher surface than the substrate to be used in the invention, voids are liable to develop between the ink-receiving layer and the substrate as the result of the shrinkage of the resins in the drying and/or cooling step following lamination of the ink-receiving layer. These voids tend to cause the scaling or flaking of the ink-receiving layer from the substrate. If such a defect is present, an recorded image will be markedly impaired.

On the contrary, the recording medium of the invention has the structure in which an ink-receiving layer is accurately formed on a substrate surface and adheres intimately thereto, since the substrate surface has such smoothness as mentioned above. Therefore, the recording medium of the invention scarcely suffers from such a defect as the scaling or flaking of the ink-receiving layer from the substrate, thus solving the above problem.

When an opaque substrate is used in the invention, its opacity needs to be at least 70%, preferably at least 90% as measured in accordance with JIS P8138. If the opacity is less than 70%, the recorded image will be dark and obscure, since transmittance of the incident light through the recording medium is high and a small proportion of the light is therefore reflected from the record.

On the other hand, the ink-receiving layer needs to have an opacity not higher than that of the substrate. In general, dyes in ink droplets applied to the surface of an ink-receiving layer penetrate and diffuse thereinto and held in dispersed form therein. Accordingly, if the ink-receiving layer has a high opacity, a large proportion of the incident light will be reflected by the ink-receiving layer, and consequently, a small proportion of the light will be reflected after arriving at the dyes dispersed in the ink-receiving layer. As the result, the recorded image will look whitish and dull without distinctness.

For these reasons, it is desirable for obtaining a highly distinct image that the ink-receiving layer be more transparent while the substrate exhibits a higher reflectivity to incident light. That is, the ink-receiving layer needs to have an opacity not higher than that of the substrate, and it is desirable in the invention that the difference in opacity therebetween be larger.

The substrate used in the invention may be formed of any suitable material hitherto known. Suitable transparent substrates include, e.g. films or plates of polyester resins, diacetate resins, triacetate resins, acrylic resins, polycarbonate resins, polyvinyl chloride resins, polyimide resins, Cellophane (trademark) and Celluloid (trademark), and glass plates. Suitable opaque substrates include, e.g. ordinary paper, clothes, wood plates, metal plates, opaque films, synthetic papers, and further products of treating the transparent substrates to make them opaque.

The ink-receiving layer used in the invention may be formed of one or more materials, as desired, having affinity for water and polyhydric alcohols, which are liquid components of inks. Such materials include natural resins, e.g. polyvinyl alcohol albumin, gelatin, casein, starch, cationic starch, gum arabic, and sodium alginate and synthetic resins, e.g. polyamide, polyvinylpyrrolidone and quaternary salts thereof, polyethyleneimine, polyvinylpyridinium halide, melamine resin, polyurethane, carboxymethylcellulose, polyester, SBR latex, NBR latex, polyviny formal, polyvinyl methacrylate, polyvinylbutyral, polyacrylonitrile, polyvinyl chloride, polyvinyl acetate, phenolic resin, and alkyd resin.

For the purpose of further improving the ink receptivity of the ink-receiving layer or opacifying the layer, a filler can be dispersed therein such as silica, clay, talc, diatomaceous earth, calcium carbonate, calcium sulfate, barium sulfate, aluminum silicate, synthetic zeolite, alumina, zinc oxide, lithopone, and satin white.

Suitable mixing ratios of the filler to the resin are 1.5 to 0. The mixing ratio of more than 1.5 is undesirable since it lowers the gloss of the recording surface, the distinctness of the image, and the contrast.

The ink-receiving layer can be formed in the following ways: Preferably, the resin and, if necessary, the filler mentioned above, are dissolved or dispersed in a suitable solvent to prepare a coating liquid, which is then applied on the above-mentioned transparent type of substrate by a conventional coating method, e.g. the roll coating, rod bar coating, spray coating, or air-knife coating method, and then the coating product is dried quickly. Alternatively, a mixture of the resin and the filler is applied by hot melt coating, or a sheet for use as the ink-receiving layer is formed separately from the above materials and laminated with the above substrate.

Besides the above coating methods, the cast coating method may be applied as occasion demands.

The thickness of the ink-receiving layer is generally about 0.1 to 200 μm, preferably about 5 to 100 μm.

The present invention has been described above with reference to typical embodiments of the recording medium of the invention. However, it is a matter of course that the recording medium is not limited to these embodiments. In any of the embodiments, the ink-receiving layer and/or a protective layer formed thereon may contain various known additives such as a dispersant, a fluorescent dye, a pH adjusting agent, an antiforming agent, a lubricant, a preservative, and a surfactant.

The present invention is illustrated in more detail with reference to the following examples. In these examples, parts are all based on weight.

EXAMPLE 1

On an art paper (supplied by Oji Paper Co., Ltd.; tradename OK Art Post) substrate, the following composition was applied by means of a bar coater so as to obtain a coating of 1.5 μm dry thickness. The coated substrate was dried at 80° C. for 10 min., thus preparing a recording medium (a) of the invention.

| Composition: | |
|---|---|
| Hydroxyethylcellulose (supplied by Fuji Chemicals Co., Ltd.; tradename: HEC AG-15) | 5 parts |
| Barium sulfate | 1 part |
| Water | 94 parts |

EXAMPLE 2

On a cast-coated paper (supplied by Kanzaki Paper Mfg. Co., Ltd., tradename: Mirror Coat) as a substrate, the following composition was applied by means of a bar coater so as to give coating of 5 μm dry thickness. The resulting sheet was dried at 100° C. for 5 min., thus preparing a recording medium (b) of the invention.

| Composition: | |
|---|---|
| Polyvinylpyrrolidone (supplied by GAF Corp.; tradename: PVP K-90) | 5 parts |
| Polyvinyl alcohol (supplied by Kuraray Co., Ltd.; tradename: PVA 220) | 5 parts |
| Water | 90 parts |

EXAMPLE 3

On a PET film (supplied by Toray Industries Inc., tradename: Q-80) as a substrate, the following composition was applied by means of a bar coater so as to give a coating of 15 μm dry thickness. The resulting sheet was dried at 60° C. for 15 min., thus preparing a recording medium (c) of the invention.

| Composition: | |
|---|---|
| Polyvinyl alcohol (supplied by Kuraray Co., Ltd.; tradename: PVA-420H) | 8 parts |
| Plastic pigment (supplied by Asahi-Dow Inc.; tradename: L-8801) | 20 parts |
| Water | 72 parts |

COMPARATIVE EXAMPLE 1

The same art paper as used in Example 1, herein designated as a recording medium (d), was tested as such for comparison.

COMPARATIVE EXAMPLE 2

A sheet of commercial glossless coated paper for ink-jet recording (supplied by Mitsubishi Paper Mills, Ltd.; tradename: IJ Mat Coat M), herein designated as recording medium (e), was tested as such for comparison.

EXAMPLE 4

On a paper substrate, having a Bekk smoothness of 610 sec. (supplied by Sanyo Kokusaku Pulp Co., Ltd.; tradename: Kintai Coat), the following composition was applied by means of a bar coater so as to give a coating of 2 μm dry thickness. The resulting sheet was dried at 80° C. for 10 min., thus preparing a recording medium (f) of the invention.

| Composition: | |
|---|---|
| Hydroxyethylcellulose (supplied by Fuji Chemicals Co., Ltd.; tradename: HEC AG-15) | 5 parts |
| Calcium carbonate (supplied by Sankyo Seifun Co., Ltd.; tradename: Eskaron #2000) | 5 parts |
| Water | 90 parts |

EXAMPLE 5

On a paper substrate having a Bekk smoothness of 186 sec. sapplied by Kanzaki Paper Mfg. Co., Ltd.; tradename: LOSTON Color), the following composition was applied by means of a bar coater so as to give a coating of 5 μm dry thickness. The resulting sheet was dried at 100° C. for 10 min., thus preparing a recording medium (g) of the invention.

| Composition: | |
|---|---|
| Polyvinylpyrrolidone (supplied by GAF Corp.; tradename: PVP K-90) | 5 parts |
| Polyvinyl alcohol (supplied by Kuraray Co., Ltd.; tradename: PVA 217) | 5 parts |
| Water | 90 parts |

EXAMPLE 6

On a paper substrate having a Bekk smoothness of 68 sec. (spplied by Kanzaki Paper Mfg. Co., Ltd.; tradename: New Age), the following comopsition was applied by means of a bar coater so as to give a coating of 10 μm dry thickness. The resulting sheet was dried at 60° C. for 10 min., thus preparing a recording medium (h) of the invention.

| Composition: | |
|---|---|
| Polyvinyl alcohol (supplied by Kuraray Co., Ltd.; tradename: PVA-420H) | 8 parts |
| Silica gel (supplied by Fuji-Davison Chemical, Ltd.; tradename SYLOID 74) | 5 parts |
| Water | 87 parts |

COMPARATIVE EXAMPLE 3

A recording medium (i) was prepared in the same manner as in Example 4 except for using paper (supplied by Sanyo Kokusaku Pulp Co., Ltd.; tradename Ginrin) having a Bekk smoothness of 28 sec., as the substrate.

COMPARATIVE EXAMPLE 4

A recording medium (j) was prepared in the same manner as in Example 5 except for using paper (supplied by Sanyo Kokusaku Pulp Co., Ltd.; tradename Ginzan) having a Bekk smoothness of 34 sec., as the substrate.

EXAMPLE 7

Coated paper (supplied by Sanyo Kokusaku Pulp Co., Ltd.; tradename SK Coat) was used for the substrate. The surface roughness of this paper, expressed in terms of the maximum height per a base length of 2.5 mm, was 5 μm as measured in accordance with JIS B0601. The following composition was applied on this substrate by means of a bar coater so as to give a coating of 2 μm dry thickness. The resulting sheet was dried at 80° C. for 10 min., thus preparing a recording medium (k) of the invention.

| Composition: | |
|---|---|
| Hydroxyethylcellulose (supplied by Fuji Chemicals Co., Ltd.; tradename: HEC AG-15) | 5 parts |
| Calcium carbonate (supplied by Sankyo Seifun Co., Ltd.; tradename: Eskaron #2000) | 5 parts |
| Water | 90 parts |

On this recording medium, images were formed and evaluated by conducting ink-jet recording as described later.

COMPARATIVE EXAMPLE 5

A recording medium (l) was prepared in the same manner as in Example 7 except for using a paper substrate (basis weight 60 g/m$^2$, hand-made from 100% NBKP) the surface roughness of which, expressed in terms of the maximum height per a base length of 2.5 mm, was 38 μm as measured in accordance with JIS B0601.

On the thus prepared recording medium, images were formed and evaluated by conducting ink-jet recording as described later.

EXAMPLE 8

Paper (basis weight 60 g/m$^2$, hand-made from 100% NBKP) was used as a substrate. The surface roughness of this paper, expressed in terms of the maximum height per a base length of 2.5 mm, was 11 μm as measured in accordance with JIS B0601. The following composition was applied on this substrate by means of a bar coater so as to give a coating of 5 μm dry thickness. The resulting sheet was dried at 100° C. for 10 min., thus preparing a recording medium (m) of the invention.

| Composition: | |
|---|---|
| Polyvinylpyrrolidone (supplied by GAF Corp.; tradename: PVP K-90) | 5 parts |
| Polyvinyl alcohol (supplied by Kuraray Co., Ltd.; tradename: PVA 217) | 5 parts |
| Water | 90 parts |

On this recording medium, images were formed and evaluated by conducting ink-jet recording as described later.

COMPARATIVE EXAMPLE 6

A recording medium (n) was prepared in the same manner as in Example 8 except for using a paper substrate (basis weight 60 g/m$^2$, hand-made from 100% NBKP) the surface roughness of which, expressed in terms of the maximum height per a base length of 2.5 mm, was 71 μm as measured in accordance with JIS B0601.

On the thus prepared recording medium, images were formed and evaluated by conducting ink-jet recording as described later.

EXAMPLE 9

Paper (basis weight 60 g/m$^2$, hand-made from 100% NBKP) was used as the substrate. The surface roughness of this paper, expressed in terms of the maximum height per a base length of 2.5 mm, was 18 μm as measured in accordance with JIS B0601. The following composition was applied on this substrate by means of a bar coater so as to give a coating of 10 μm dry thickness. The resulting sheet was dried at 60° C. for 10 min., thus preparing a recording medium (o) of the invention.

| Composition: | |
|---|---|
| Polyvinyl alcohol (supplied by Kuraray Co., Ltdl; tradename: PVA-420H) | 8 parts |
| Silica gel (supplied by Fuji-Davison Chemical, Ltd.; tradename: Siloid 74) | 5 parts |
| Water | 87 parts |

The surface roughness of the substrates used in Examples 7–9 and Comparative Examples 5 and 6 above was determined by measuring the respective maximum heights of projections in 2.5-mm base lengths at 10 arbitrary points on the ink-receiving surface using a Talysurf 4 (supplied by Taylor-Hobson Co.) in accordance with JIS B0601 and averaging the observed values.

EXAMPLE 10

On an art paper substrate (supplied by Oji Paper Co., Ltd.; tradename: OK Art Post), the following composition was applied by means of a bar coater so as to give a coating of 5 μm dry thickness. The resulting sheet was dried at 100° C. for 5 min., thus preparing a recording medium (p) of the invention.

| Composition: | |
|---|---|
| Polyvinylpyrrolidone (supplied by GAF Corp.; tradename: PVP K-90) | 5 parts |
| Polyvinyl alcohol (supplied by Denki Kagaku Kogyo K.K.; tradename: B-20) | 5 parts |
| Water | 90 parts |

EXAMPLE 11

On the art paper substrate as used in Example 10, the following composition was applied by means of a bar coater so as to give a coating of 7 μm dry thickness. The resulting sheet was dried at 80° C. for 10 min., thus preparing a recording medium (q) of the invention.

| Composition: | |
|---|---|
| Polyvinyl alcohol (supplied by The Nippon Synthetic Chem. Ind. Co., Ltd.; tradename: Gosenol KH-17) | 5 parts |
| Talc (supplied by Tsuchiya Kaolin Co., Ltd.; tradename: SWS) | 5 parts |
| Water | 90 parts |

EXAMPLE 12

On a synthetic paper substrate (supplied by Oji-Yuka Goseishi Co., Ltd.; tradename: Yupo), the following composition was applied by means of a bar coater so as to give a coating of a 5 μm dry thickness. The resulting sheet was dried at 80° C. for 20 min., thus preparing a recording medium (r) of the invention.

| Composition: | |
|---|---|
| Hydroxyethylcellulose (supplied by Fuji Chemicals Co., Ltd.; tradename: HEC AG-15) | 5 parts |
| Water | 95 parts |

COMPARATIVE EXAMPLE 7

A recording medium (s) was prepared in the same manner as in Example 10 except for using a cast-coated paper (supplied by Kanzaki Paper Mfg. Co., Ltd.; tradename: Mirror Coat) as substrate and applying the following coating composition:

| | |
|---|---|
| Polyvinyl alcohol (supplied by Denki Kagaku Kogyo K.K.: tradename: K-17S) | 3 parts |
| Titanium oxide (supplied by Ishihara Sangyo Kaisha, Ltd.; tradename: TIPAQUE R-680) | 17 parts |
| Water | 80 parts |

COMPARATIVE EXAMPLE 8

A recording medium (t) was prepared in the same manner using the art paper substrate as in Example 10 except for applying the following coating composition:

| | |
|---|---|
| Polyvinyl alcohol (supplied by Denki Kagaku Kogyo K.K.: | 2 parts |

-continued

| | |
|---|---|
| tradename: K-17S) | |
| Clay (supplied by Tsuchiya Kaolin Co., Ltd.; tradename: Super Floss) | 18 parts |
| Water | 80 parts |

On the recording media prepared in the above examples and comparative examples, ink-jet recording was performed by using a recorder provided with an on-demand type of head from which inks can be ejected by means of piezo-electric oscillators (orifice diameter 60 μm, piezo oscillator driving voltage 70 V, frequency 2 KHz) and the following four different inks:

| | |
|---|---|
| Yellow ink (composition) | |
| C.I. Direct Yellow 86 | 2 parts |
| Diethylene glycol | 20 parts |
| Polyethylene glycol #200 | 10 parts |
| Water | 70 parts |
| Red ink (composition) | |
| C.I. Acid Red 35 | 2 parts |
| Diethylene glycol | 20 parts |
| Polyethylene glycol #200 | 10 parts |
| Water | 70 parts |
| Blue ink (composition) | |
| C.I. Direct Blue 86 | 2 parts |
| Diethylene glycol | 20 parts |
| Polyethylene glycol #200 | 10 parts |
| Water | 70 parts |
| Black ink (composition) | |
| C.I. Food Black 2 | 2 parts |
| Diethylene glycol | 20 parts |
| Polyethylene glycol #200 | 10 parts |
| Water | 70 parts |

Results of evaluating the recording media prepared in Examples 1–3 and Comparative Examples 1 and 2 above are shown in Table 1. The evaluation items shown in Table 1 were determined in the following ways:

(1) Ink fixing time: This is the time elapsing from attaching ink droplets on the recording medium to the moment the ink was dried to such an extent that no ink sticked to the finger touching the recorded image.

(2) Optical density of ink dot: The optical density of black ink dots was determined with a microdensitometer (model Sakura PDM-5, supplied by Konishiroku Photo Industry Co., Ltd.) by applying the method of JIS K7505 to printed micro-dots.

(3) Gloss: The 60° specular gloss was measured in accordance with JIS Z8741 by using a digital varying angle glossmeter (model UGV-5, supplied by Suga Shikenki Co., Ltd.).

(4) Munsell lightness: This was determined in accordance with JIS Z8721 from the value of spectroscopic reflectivity measured by using a color analyzer (model CA-35, supplied by Murakami Color Laboratory, Ltd.).

(5) Panel test: This was conducted for comprehensive image evaluation. An illustration (10×20 cm) recorded on the recording medium was shown to 20 panelists (12 men and 8 women), and it was asked them whether the illustration looked to have a high contrast and a high quality with distinctness and depth. The result of the evaluation is represented by the number of the panelists who answered with "Yes" to this question.

TABLE 1

| Evaluation item | Recording medium a | b | c | d | e |
|---|---|---|---|---|---|
| Ink fixing time | ≦1 min | ≦1 min | ≦1 min | 5 min | ≦1 min |
| O.D. of ink dot | 1.2 | 1.3 | 1.1 | 0.5 | 0.7 |
| Gloss (%) | 35 | 60 | 75 | 25 | 4 |
| Munsell lightness | 8.8 | 9.2 | 9.3 | 9.0 | 9.2 |
| Panel test | 18 | 17 | 19 | 0 | 4 |

Results of evaluating the recording media prepared in Examples 4–6 and Comparative Examples 3 and 4 above are shown in Table 2.

The evaluation items shown in Table 2 other than those mentioned above were determined in the following manner. A mark * in the table means the ratio of the found-value variance to the average of the found value.

(6) Ink dot diameter: This was determined by using an industrial microscope (supplied by Union Kogaku Co., Ltd.).

(7) Bekk smoothness of substrate: This was determined by using an Oken's air resistance type of smoothness tester (supplied by Asahi Seiko Co., Ltd.).

(8) Panel test: This was conducted for Comprehensive image evaluation. An illustration (10×20 cm) recorded on the recording medium was shown to 50 panelists (28 men and 22 women), who were asked whether the illustration showed a high contrast and distinctness. The result of the evaluation is represented by the number of the panelists who answered with "Yes" to this question.

TABLE 2

| Evaluation item | Recording medium f | g | h | i | j |
|---|---|---|---|---|---|
| Ink fixing time | ≦1 min | ≦1 min | ≦1 min | ≦1 min | ≦1 min |
| *O.D. of ink dot | 0.018 | 0.015 | 0.018 | 0.087 | 0.092 |
| *Ink dot diameter | 0.022 | 0.019 | 0.020 | 0.072 | 0.089 |
| Bekk smoothness of substrate | 610 sec. | 186 sec. | 68 sec. | 28 sec. | 34 sec. |
| Gloss | 68 | 51 | 62 | 12 | 28 |
| Munsell lightness | 9.0 | 8.6 | 9.2 | 8.9 | 9.0 |
| Panel test | 38 | 42 | 40 | 5 | 8 |

Results of evaluating the recording media prepared in Examples 7–9 and Comparative Examples 5 and 6 above are shown in Table 3.

The evaluation items shown Table 3 where determined in the following manner, except for the items described above.

(9) Variation in ink dot O.D.: From black ink dots marked with the same amounts of ink droplets under the same conditions, 50 dots were arbitrarily selected and the O.D. of each dot was measured by using a microdensitometer (tradename, model PDM-5, supplied by Konishiroku Photo Industry Co., Ltd.). The variance and average of the found values were calculated, and the ratio of the variance to the average was obtained as an indication of the variation in ink dot O.D.

(10) Variation in ink dot diameter: From black ink dots marked with the same amounts of ink droplets under the same conditions, 100 dots were arbitrarily selected and the diameter of each dot was measured with a stereomicroscope. The variance and average of the found values were calculated, and the ratio of the variance to the average was obtained as an indication of the variation in ink dot diameter.

(11) Ink dot shape: From ink dots marked on each of the recording media, 100 dots were arbitrarily selected, and the shape of each dot was observed with a stereomicroscope. The shapes of the 100 dots were classified into three groups. The rating marks mean the following cases:

o . . . At least 90% of the 100 dots were observed to have good circularty.

Δ . . . Intermediate between the ratings of o and x.

x . . . At least 90% of the 100 dots were observed not to be circular.

(12) Organoleptic test of recorded images by visual observation: This was conducted for comprehensive image evaluation. Illustrations (10×20 cm) recorded by ink-jet recording on five recording media prepared in Examples 7–9 and Comparative Examples 5 and 6 were visually observed under the same environmental conditions by employing 20 panelists (12 men and 8 women). Thereby the five illustrations were rated by each panelist with points of from 5 to 1 in order of from the best to the worst with respect to the contrast and distinctness of image. The respective rating points given by all the panelists to each illustration were totaled and defined as the rating points of the illustration.

TABLE 3

| Evaluation item | Recording medium k | m | o | l | n |
|---|---|---|---|---|---|
| Variation in ink dot O.D. | 0.016 | 0.018 | 0.021 | 0.062 | 0.082 |
| Variation in ink dot diameter | 0.021 | 0.030 | 0.028 | 0.076 | 0.078 |
| Ink dot shape | o | o | o | Δ | x |
| Organoleptic test by visual observation | 92 points | 76 points | 72 points | 32 points | 28 points |
| Gloss (%) | 75 | 52 | 47 | 20 | 8 |
| Munsell lightness | 8.9 | 8.4 | 8.2 | 8.2 | 9.1 |

Results of evaluating the recording media prepared in Examples 10–12 and Comparative Examples 7 and 8 above are shown in Table 4. The evaluation items shown in Table 4 were determined in the following ways, except the items described above.

(13) Opacity: Opacities of both the substrate and the ink-receiving layer were measured by using a Hunter color photometer (supplied by Toyo Seiki Co., Ltd.) in accordance with JIS P8138. The opacity of the ink-receiving layer were measured on the film prepared by applying the coating liquid on a polyethylene film, drying the coat, and peeling it from the polyethylene film.

(14) Panel test: This was conducted for comprehensive image evaluation. An illustration (10×20 cm) recorded on the recording medium was observed by 20 panelists (12 men and 8 women), and it was asked them whether the image exhibits a high contrast and distinctness. The case where at least 15 of the panelists answered "Yes" to this question was marked with o, and other cases were marked with x.

TABLE 4

| Evaluation item | Recording medium p | q | r | s | t |
|---|---|---|---|---|---|
| Ink fixing time | ≦1 min | ≦1 min | ≦1 min | ≦1 min | ≦1 min |
| O.D. of ink dot | 1.3 | 1.2 | 1.3 | 0.7 | 0.8 |
| Opacity of substrate (%) | 93.2 | 93.2 | 97.8 | 94.7 | 93.2 |
| Opacity of ink-receiving layer (%) | 2.6 | 40.2 | 4.0 | 95.1 | 96.1 |
| Gloss | 72 | 61 | 78 | 18 | 6 |
| Munsell lightness | 9.0 | 8.1 | 9.2 | 9.3 | 8.2 |
| Panel test | o | o | o | x | x |

As demonstrated above, ink-jet recording on the recording medium having a 60° specular gloss of at least 30% as measured in accordance with JIS Z8741 and a Munsell lightness of at least 7.5 as measured in accordance with JIS Z8721 provides images high in O.D. and in contrast, superior in distinctness, and giving mellowness and high-quality sensation.

Secondly, ink dots uniform in diameter and in O.D. are obtainable by ink-jet recording on the recording medium of the present invention wherein the substrate has a Bekk smoothness of at least 50 sec. as measured in accordance with JIS P8119. Accordingly, it is possible to record full-color images high in contrast, superior in distinctness, and having a high quality.

Thirdly, on the recording medium of the invention, superior quality images with high resolution can be recorded since the substrate surface in contact with the ink-receiving layer has a prescribed roughness. In addition, images giving perspective feeling and high-quality sensation can be recorded on this recording medium since the recording surface thereof has a high gloss.

Fourthly, the recording medium of the invention has structural advantages in that the ink-receiving layer can be formed to adhere intimately to the substrate without developing any appreciable void and hence the void-attributable scaling or flaking of the ink-receiving layer scarcely from the substrate scarcely takes place.

The recording medium of the invention, although described hereinbefore referring to the application to ink-jet recording, is not particularly limited to this but is free to use for any recording method employing inks, for example, thermography.

We claim:

1. A recording medium comprising a substrate and an ink-receiving layer formed on the substrate, said substrate having a Bekk smoothness of at least 50 seconds as measured in accordance with JIS P8199 and having an opacity equal to or greater than the opacity of said ink-receiving layer; and the surface of said ink-receiving layer having a 60° specular gloss of at least 30 percent as measured in accordance with JIS Z8741.

2. A recording medium according to claim 1, wherein said ink-receiving layer is light-transmissive.

3. A recording medium according to claim 1, wherein said ink-receiving layer contains a resin.

4. A recording medium according to claim 1, wherein said ink-receiving layer further contains a filler in an amount such that the ratio of said resin to said filler is from 0 to 1.5.

5. An ink jet recording method comprising depositing ink droplets onto a recording medium, said recording medium comprising a substrate and an ink-receiving layer formed on the substrate, said substrate having a Bekk smoothness of at least 50 seconds as measured in-accordance with JIS P8119 and having an opacity equal to or greater than the opacity of said ink-receiving layer; and the surface of said ink-receiving having a 60° specular gloss of at least 30 percent as measure in accordance with JIS Z8741.

6. A color-image-forming method comprising depositing droplets of yellow, magenta, cyan or black colored ink on a recording medium to form a color image, said recording medium comprising a substrate and an ink-receiving layer formed on the substrate, said substrate having a Bekk smoothness of at least 50 seconds as measured in accordance with JIS P8119 and having an opacity equal to or greater than the opacity of said ink-receiving layer; and the surface of said ink-receiving layer having a 60° specular gloss of at least 30 percent as measured in accordance with JIS Z8741.

* * * * *

UNITED STATES PATENT AND TRADEMARK OFFICE

CERTIFICATE OF CORRECTION

PATENT NO. : 4,664,952

DATED : May 12, 1987

INVENTOR(S) : RYUICHI ARAI, ET AL.

It is certified that error appears in the above-identified patent and that said Letters Patent is hereby corrected as shown below:

AT [57] IN THE ABSTRACT

Line 6, "employ" should read --employs--.
Line 7, "above mentioned" should read --above-mentioned--.

COLUMN 1

Line 22, "high speed" should read --high-speed--.
Line 38, "medium" should read --media--.
Line 62, "ink droplets as many" should read --as many ink droplets--.
Line 65, "not" should be deleted.

COLUMN 2

Line 44, "to further" should read --to a further--.

COLUMN 3

Line 6, "Frenel's" should read --Fresnel's--.
Line 41, "diamters" should read --diameters--.
Line 62, "500 sec." should read --50 sec.--.
Line 66, "means, may" should read --means may--.

COLUMN 4

Line 22, "Reasons" should read --The reasons--.
Line 31, "tood" should read --good--.
Line 65, "an" should read --a--.

COLUMN 5

Line 20, "held" should read --are held--.

UNITED STATES PATENT AND TRADEMARK OFFICE

CERTIFICATE OF CORRECTION

PATENT NO. : 4,664,952

DATED : May 12, 1987

INVENTOR(S) : RYUICHI ARAI, ET AL.

It is certified that error appears in the above-identified patent and that said Letters Patent is hereby corrected as shown below:

COLUMN 5

Line 41, "clothes," should read --cloth,--.
Line 49, "alcohol" should read --alcohol,--.

COLUMN 6

Line 24, "antiforming" should read --antifoaming--.

COLUMN 7

Line 48, "sec. sapplied" should read --sec. (supplied--.
Line 67, "(spplied" should read --(supplied--.
Line 68, "comopsition" should read --composition--.

COLUMN 9

Line 47, "Ltdl;" should read --Ltd;--.

COLUMN 12

Line 53, "where" should read --were--.

COLUMN 13

Line 13, "circularty." should read --circularity.--
Line 33, In TABLE 3, "k m o l n" should read --k l m n o--.

COLUMN 14

Line 45, "scarcely from" should read --from--.

UNITED STATES PATENT AND TRADEMARK OFFICE

CERTIFICATE OF CORRECTION

PATENT NO. : 4,664,952

DATED : May 12, 1987

INVENTOR(S) : RYUICHI ARAI, ET AL.

It is certified that error appears in the above-identified patent and that said Letters Patent is hereby corrected as shown below:

COLUMN 14

Line 55, "JIS P8199" should read --JIS P8119--.

COLUMN 15

Line 6, "in-accordance" should read --in accordance--.
Line 9, "ink-receiving having" should read --ink-receiving layer having--.
Line 10, "measure" should read --measured--.

Signed and Sealed this

Twenty-fifth Day of August, 1987

*Attest:*

*Attesting Officer*

DONALD J. QUIGG

*Commissioner of Patents and Trademarks*